United States Patent [19]

Boxall

[11] Patent Number: 4,932,561

[45] Date of Patent: Jun. 12, 1990

[54] BEVERAGE COOLING AND DISPENSING APPARATUS

[76] Inventor: Stanley S. Boxall, P.O. Box 80383, Atlanta, Ga. 30366

[21] Appl. No.: 272,770

[22] Filed: Nov. 17, 1988

Related U.S. Application Data

[63] Continuation-in-part of Ser. No. 922,567, Oct. 24, 1986, abandoned.

[51] Int. Cl.[5] ..... B67D 5/08; B67D 5/62

[52] U.S. Cl. ..... 222/54; 222/638; 222/129.1; 222/146.6; 222/185; 137/487.5

[58] Field of Search ..... 141/197; 222/52, 54, 222/56, 59, 61, 638–642, 644, 129, 129.1–129.4, 136, 146.6, 181, 185, 399, 400.7, 400.8, 564; 137/487.5

[56] References Cited

U.S. PATENT DOCUMENTS

| | | | |
|---|---|---|---|
| 196,297 | 10/1877 | Hovey | 222/400.8 |
| 1,919,257 | 7/1933 | Renzenhausen | 222/400.8 |
| 2,256,550 | 9/1941 | Colvin | 222/136 |
| 2,727,667 | 12/1955 | Booth | 222/640 |
| 2,997,208 | 8/1961 | Kish | 222/640 |
| 3,200,994 | 8/1965 | Levinson et al. | 222/400.7 |
| 3,774,820 | 11/1973 | Zucconi | 222/400.7 |
| 4,143,793 | 3/1979 | McMillin et al. | 222/61 |
| 4,243,158 | 1/1981 | Negosta | 222/564 |
| 4,316,557 | 2/1982 | Benoun et al. | 222/129.1 |
| 4,344,467 | 8/1982 | Lahde | 141/197 |
| 4,512,377 | 4/1985 | Greer | 222/129 |
| 4,513,881 | 4/1985 | Heimovics, Jr. | 222/54 |
| 4,560,089 | 12/1985 | McMillin et al. | 222/61 |
| 4,664,297 | 5/1987 | Giovinazzi | 222/584 |
| 4,676,403 | 6/1987 | Goudy, Jr. et al. | 222/54 |
| 4,708,266 | 11/1987 | Rudick | 222/129.1 |
| 4,714,098 | 12/1987 | Stuckel | 141/197 |

FOREIGN PATENT DOCUMENTS

| | | | |
|---|---|---|---|
| 806764 | 10/1936 | France | 222/518 |

*Primary Examiner*—Michael S. Huppert
*Assistant Examiner*—Steven Reiss
*Attorney, Agent, or Firm*—Jones, Askew & Lunsford

[57] ABSTRACT

A compact and inexpensive apparatus for cooling and dispensing premixed beverages. The apparatus holds one or more conventional bottles of beverage, including carbonated as well as noncarbonated beverages, and chills these beverages for dispensing drinks from a tap. Pressure is maintained within the bottled beverages, either with compressed air or with carbon dioxide or other gases, to keep premixed carbonated beverages from going flat or to preserve the beverages. The source of pressure can automatically operate to supply pressurized air to the bottle for a predetermined time whenever liquid is dispensed, so as to pressurize the added head space created in the bottle by each dispensing operation.

10 Claims, 5 Drawing Sheets

BEVERAGE COOLING AND DISPENSING APPARATUS

CROSS-REFERENCE TO RELATED APPLICATION

This is a continuation-in-part of Ser. No. 922,567 filed Oct. 24, 1986, now abandoned.

FIELD OF THE INVENTION

This invention relates in general to apparatus for dispensing beverages, and relates in particular to apparatus for dispensing premixed beverages directly from the bottles in which the beverages are commonly available.

BACKGROUND OF THE INVENTION

Many popular beverages are available either in premixed or post-mixed form. "Premixed" in this usage means that the beverage is packaged and sold as intended for consumption, including carbonation as appropriate. With "post-mixed" beverages, in comparison, the beverage is available in a concentrate such as syrup or the like. This concentrate becomes diluted and mixed with water at the point of dispensing for consumption, and $CO_2$ gas is then added to the mixture if the mixed beverage is carbonated. Some popular beverages are available either in premixed or post-mixed form, examples of these being cola beverages and other soft drinks. Other beverages are available only in one form; juices and other "still" or noncarbonated beverages are frequently available only as premixed beverages ready for consumption.

Soft drinks and some other premixed beverages are generally available either in bottles or cans containing only an individual serving of the beverage, or in larger bottles containing a quantity sufficient for many servings. Examples of the latter-sized bottles are the quart and multi-liter bottles of carbonated soft drinks. Neither the individual container nor the multi-serving container is entirely appropriate for many users.

For example, a consumer may simply desire less beverage than the quantity typically in individual-sized cans or bottles. The remaining beverage soon loses its carbonation and thus becomes unpalatable, even where efforts are made to reclose or reseal the container. These beverage remnants usually are discarded if not consumed very soon after the can or bottle is initially opened.

The relatively larger quart or multi-liter bottles, although typically delivered with screw-threaded caps intended for reclosure, don't adequately preserve carbonated beverages. Once the carbonation is lost when the bottle is first unsealed, the sealed pressure in the head space above the liquid no longer remains and beverage eventually becomes "flat" as the carbonation in solution in the remaining gas evolves to liquid in the empty space within the bottle.

One solution to the foregoing problem is simply to use post-mixed beverages, where the syrup or concentrate is mixed with water (and is carbonated as appropriate) when the beverage is dispensed into a cup or other container. Post-mix beverage dispensing has the added advantage that the serving portion is variable, instead of determined by the size of an individual container. Notwithstanding these and other advantages of post-mixed beverages, such dispensers generally are used only in commercial or institutional applications.

The principal reasons for this limitation of use include the cost of the post-mix dispensing equipment, the relatively-large physical size of such apparatus, and the need for the apparatus to be semipermanently installed in a particular location and connected to a water line. Other disadvantages are that the user is restricted only to beverages available in concentrated form, and that both the concentrate containers and a cylinder of high-pressure $CO_2$ gas must be periodically replenished. These and other disadvantages render post-mix beverage dispensers unattractive or undesirable in most homes, small offices, and other installations.

SUMMARY OF INVENTION

Stated in general terms, the present invention is an apparatus designed to dispense pre-mixed beverages directly from bottles or other containers in which these beverages are normally available. The apparatus delays or prevents the dissolution of carbonation from the beverage by automatically injecting compressed air into the head space above the beverage within the bottle.

Stated somewhat more specifically, the present dispensing apparatus includes a housing to support at least one such bottle, and preferably several bottles, while refrigerating the bottles and their contents. When used with carbonated beverages, the present apparatus maintains pressure in the bottle sufficient to substantially retain the pre-mixed carbonation in the beverage, thereby maintaining the quality of the beverage after the bottle is first unsealed.

Stated in greater detail, the present dispensing apparatus includes a refrigerated enclosure sized to receive one or more standard bottles of pre-mixed beverages, and maintaining these beverages chilled to a temperature appropriate for drinking the beverages. Individual commercially-available bottles of beverage are easily attached to the dispensing apparatus without requiring special skill or tools for the purpose. After one or more bottles of beverage are installed in the dispensing apparatus, a dispensing tap associated with each bottle permits dispensing any desired quantity of the beverage. Where the pre-mixed beverages normally are carbonated, the present apparatus automatically maintains sufficient pressure within the empty volume of the bottle to keep the carbonating gas in solution within the beverage. This pressure is supplied either by compressed air through a compressor self-contained with the dispensing device, or with a container of compressed gas likewise contained within the apparatus. Where compressed air is utilized, the apparatus precools the air before compressing so as to dry the air and thereby avoid diluting the bottled pre-mixed beverage.

Stated with further particularity, the present dispensing apparatus can automatically refill the head space above the bottle with pressurized air each time the head space is increased by dispensing liquid from the bottle. A small air compressor supplies the pressurized air, and the compressor operates for a predetermined interval each time liquid is dispensed from the bottle. The desired maximum air pressure within the bottles is achieved either by an air compressor set to deliver no more than that desired pressure, or by a pressure-responsive control which stops the air compressor when the desired maximum pressure within the head space is reached.

OBJECTS OF THE INVENTION

Accordingly, it is an object of the present invention to provide improved dispensing apparatus for beverages.

It is another object of the present invention to provide apparatus for dispensing pre-mixed beverages directly from the beverage bottle or the like.

It is yet another object of the present invention to provide an apparatus for dispensing pre-mixed carbonated beverages while maintaining the carbonation of the beverage.

Many other objects and advantages of the present invention will become more readily apparent from the following description of a preferred embodiment.

DETAILED DESCRIPTION OF DISCLOSED EMBODIMENTS

Figure 1:
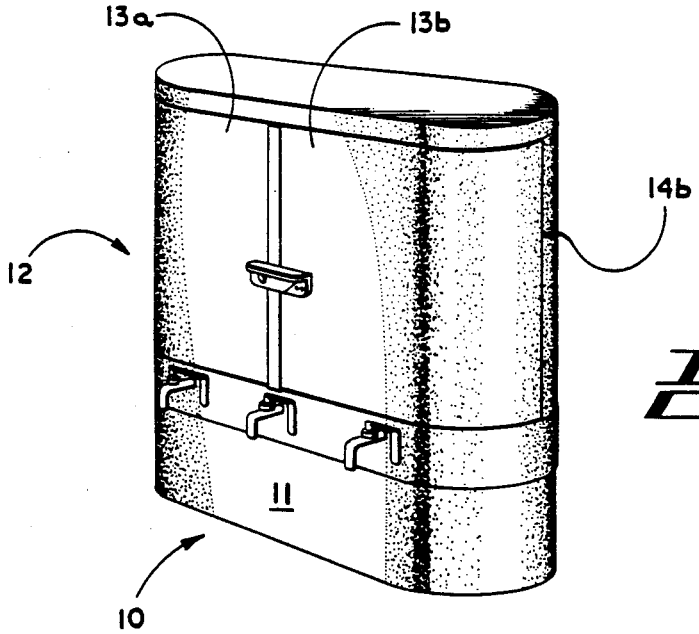
FIG. 1 is a pictorial view showing beverage dispensing apparatus according to a preferred embodiment of the present invention.
Figure 2:
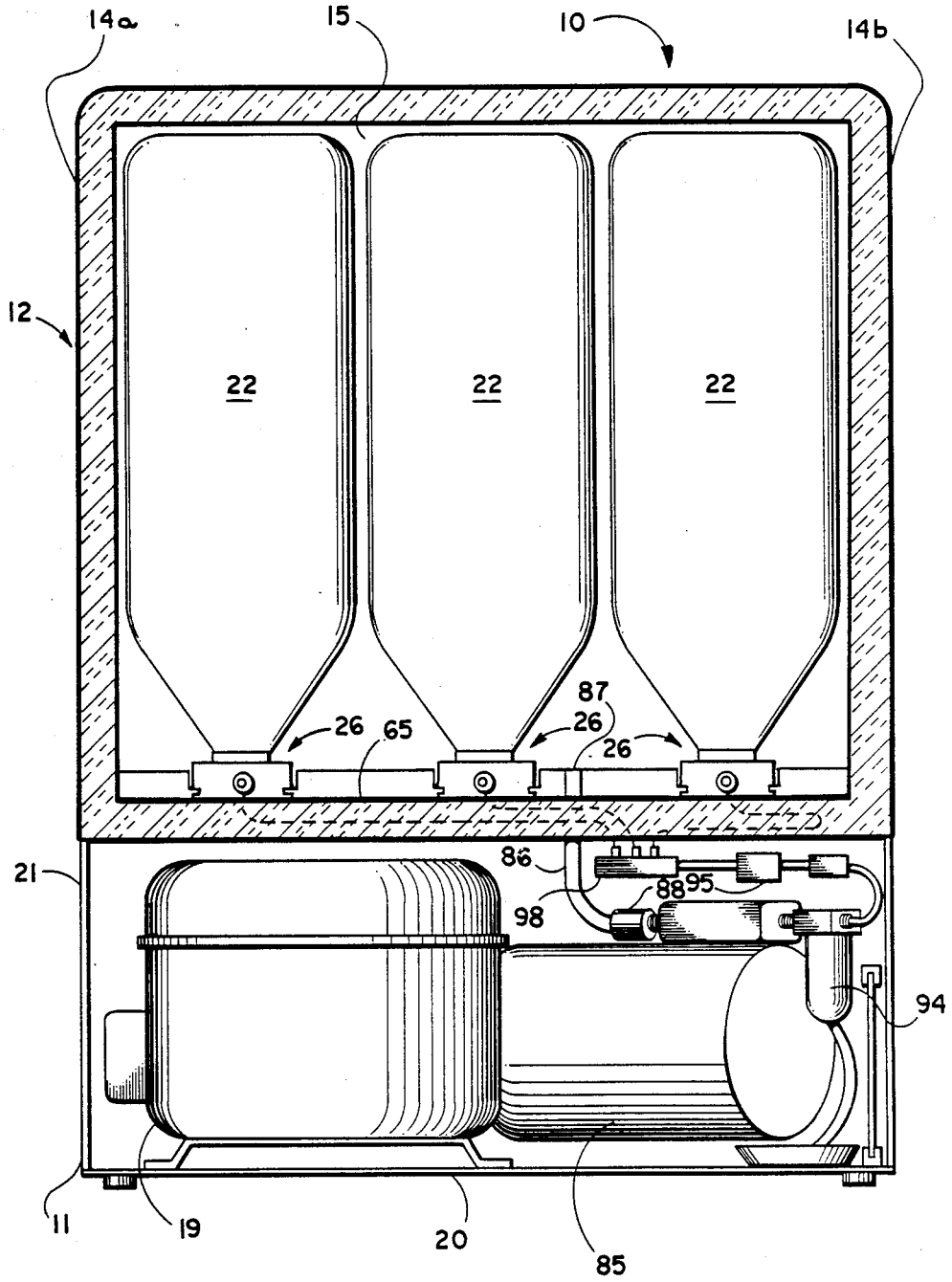
FIG. 2 is a front elevation view of the apparatus shown in FIG. 1, broken away to show interior detail.

Turning first to FIGS. 1 and 2, there is shown generally at 10 an embodiment of beverage dispensing apparatus according to the present invention. This apparatus has a base 11 designed to rest on a convenient support surface such as a counter top, and a bottle cabinet 12 mounted above the base. Substantially the entire front of the bottle cabinet 12 comprises a pair of doors 13*a* and 13*b*, each door being connected by a vertical hinge to the corresponding sides 14*a* and 14*b* of the bottle cabinet. The doors 13*a*, 13*b* swing open along these hinges to expose the interior 15 (FIG. 2) of the bottle cabinet.

The bottle cabinet 12 is refrigerated by a conventional refrigeration compressor 19 located in the base 11 below the bottle cabinet. The refrigeration system is conventional, and can include a static condenser mounted on the back of the apparatus 10. Alternatively, a fan-cooled condenser can be mounted in the base. The bottle cabinet is thermally insulated to restrict heat gain into the inside 15; the walls and other sections making up the bottle cabinet are fabricated from insulated foam material or another suitable thermal insulation, sandwiched between sheets of rigid plaster or metal. The base 11 is not refrigerated, and the base has a metal bottom plate 20 for supporting the compressor 19 and other operating components of the dispensing apparatus. A relatively thin outer panel 21 surrounds the bottom plate 20, and preferably is configured for a uniform outside configuration relative to the outside configuration of the bottle cabinet 12 mounted above the base 11.

The interior 15 of the bottle cabinet 12 in this embodiment is sized to contain three conventional beverage bottles 22 in side-by-side configuration across the width of the interior. These bottles 22 in the present embodiment are two-liter or three-liter bottles of various carbonated and pre-mixed soft drinks, although it should be understood that other sizes of containers and other kinds of beverages can be dispensed with the present invention. It will also become apparent that the present apparatus is readily converted to receive one or more bottles downsized from the largest bottle for which the particular embodiment is designed.

The bottles 22 are installed and supported in inverted configuration within the interior 15 of the bottle cabinet. Each bottle is supported within the bottle cabinet by a separate bottle connector assembly 26, which screws onto the threaded neck 27 of the bottle after the conventional bottle cap is removed. The bottle 22 with the attached bottle connector assembly 26 is then inverted and placed within the interior 15 of the bottle cabinet 12.

Figure 3:
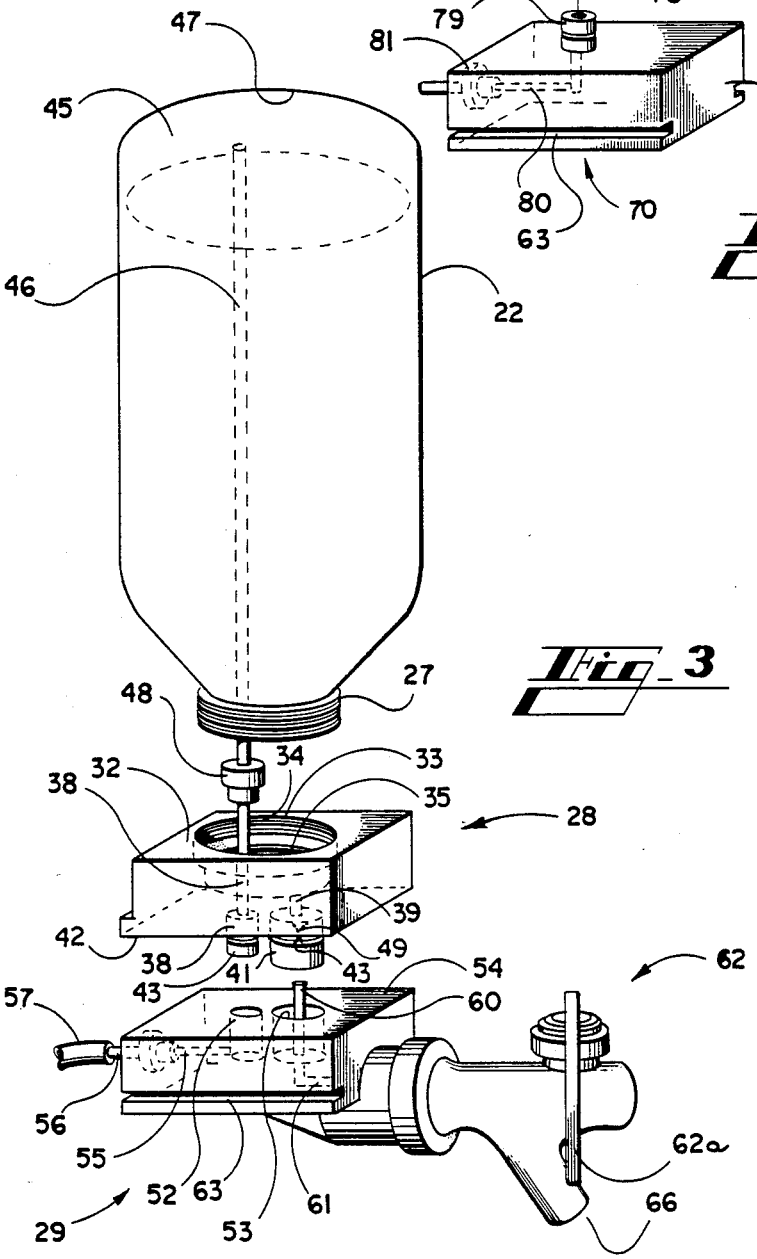
FIG. 3 is an enlarged exploded view showing details of a bottle connector assembly in the disclosed embodiment.

The first embodiment of the bottle connector assembly 26 is shown in FIG. 3. This assembly includes two major components, the bottle connector 28 which screws onto the bottle 22 and establishes two fluid flow paths into the interior of the bottle, and the flow connector 29 which remains within the bottle cabinet 12 and detachably receives the bottle connector.

The bottle connector 28 is a block having a top side 32 with the receptacle 33 formed therein to receive the threaded neck 27 of the bottle 22. The receptacle 33 in this embodiment has a first threaded diameter 34 for fitting bottles of a first size, and has a second coaxial second threaded diameter 35 below the first diameter for receiving bottles having a relatively smaller neck diameter. It will be understood that a receptacle having a single threaded diameter could be substituted for the two diameters 34 and 35. Moreover, an alternative apparatus for converting a single-diameter bottle connector to receive different bottle sizes is disclosed below.

A pair of fluid flow openings 38 and 39 are located in the bottom of the receptacle 33. These fluid flow openings extend downwardly through the bottle connector 28 and through the plugs 40, 41 extending downwardly from the underside 42 of the flow connector. An O-ring 43 surrounds the outside of each plug 40 and 41; these plugs preferably have dissimilar diameters or are otherwise nonidentical with each other, to insure that the bottle connector 28 can attach to the flow connector 29 in only one way.

A length of tubing 46 connects to the first flow opening 38 in the bottle connector 28. This tubing 46 can be long enough to extend almost to the bottom 47 within the bottle 22 if agitation caused by gas bubbling through the bottled beverage is detrimental. A check valve 48 is connected in line with the tubing 46, permitting fluid flow only into the bottle 22 through the first flow opening 38 in the bottle connector. A normally-closed flap valve 49 is in the second flow opening 39, between the bottom of the receptacle 33 and the flow outlet at the bottom of the plug 41. This valve 49 is opened only when the bottle connector 28 is attached to the flow connector 29, as explained below.

The flow connector 29 in normal use remains within the interior 15 of the bottle cabinet 12, and the bottle connector 28 selectively attaches to the flow connector for establishing two flow paths into the interior of the bottle 22. Each flow connector 29 comprises a rectangular block 50 having a first opening 52 and a second opening 53 formed in the top surface 54. These openings 52 and 53 are sized for complementary fits with the corresponding plugs 40 and 41 on the bottle connector 28, the O-rings 43 on the plugs assuring a fluid-tight seal. A fluid passage 55 is formed in the block 50 in communication with the first opening 52, and extends rearwardly to a fluid connector 56 at the back of the flow connector 29. The connector 56 removably connects to a pressurized-air inflow conduit 57, described below in greater detail. Air inflow from the line 57 to the tubing 46 within the bottle 22 thus is established when the bottle connector assembly 26 is attached to the flow connector 29.

A hollow rigid tube 60 protrudes upwardly from the bottom of the second opening 52 in the block 50. This tube 60 is coaxially aligned with the second flow opening 39 extending through the plug 41 on the bottle connector 28, and the tube enters that opening to open the normally-closed flap valve 49 when the bottle connector is attached to the flow connector 29. A fluid passage 61 extends through the block 50, establishing a flow path from the hollow tube 60 to the spigot assembly 62 extending forwardly from the block.

A groove 63 extends longitudinally along each side 64 of the block 50. These grooves 63 mate with corresponding protrusions spaced a short distance above the floor 65 in the interior of the bottle cabinet, allowing sliding withdrawal of the individual flow connectors 29 from the bottle cabinet for periodic cleaning. The flow connectors 29 otherwise remain in the bottle cabinet 12, with the bottle connectors 26 being unplugged from the flow connectors whenever an empty bottle 22 is being replaced by a full bottle.

The tap assembly 62 is of conventional construction, having an actuator 62*a* which selectively opens a flow path from the fluid passage 61 to the spigot 66.

Figure 4:
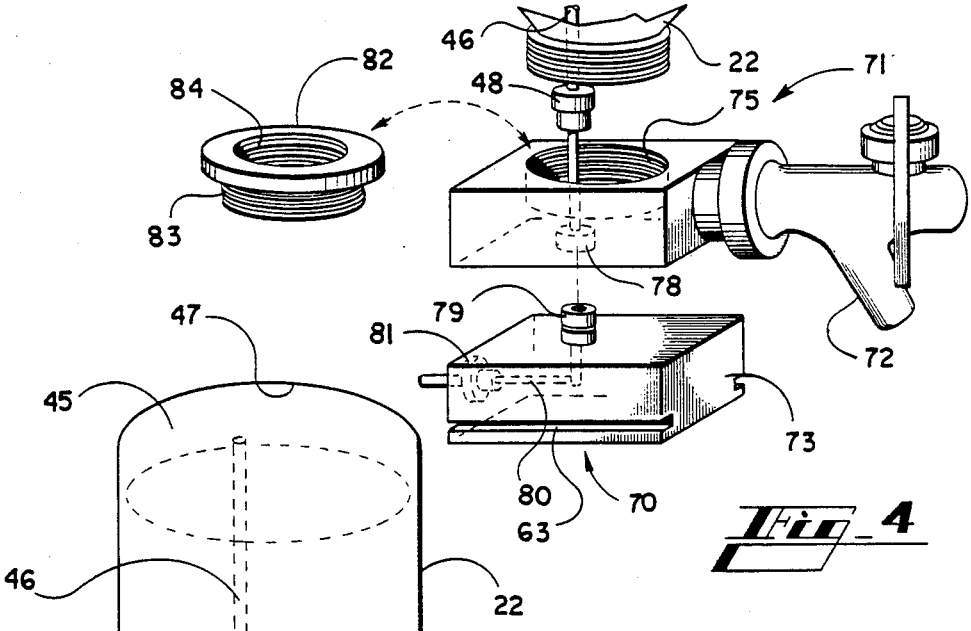
FIG. 4 shows an alternative embodiment of a bottle connector assembly and a bottle size adapter for the disclosed embodiment.

FIG. 4 shows an alternative bottle connector assembly 70, in which the spigot 72 attaches to the bottle connector 71 instead of the flow connector 73. The liquid flow passage within the spigot 72 communicates with an opening at the bottom of the bottle-receiving receptacle 75 on the top of the bottle connector 71. The receptacle 75 is sized and threaded to fit on only a single size of bottle, but can be adapted to fit other bottle neck sizes as discussed below. The normally-closed valve 49 of the previous embodiment is not required in the connector assembly 70.

A tube 46 and check valve 48, corresponding in construction and function to the like-numbered elements in FIG. 3, extend upwardly from another opening 78 in the bottom of the receptacle 75. The lower end of the opening 78 is enlarged to receive the plug 79 extending upwardly from the top of the flow connector 73. An air flow passage 80 is formed in the plug 79 and extends through the flow connector 73 to terminate at a connector 81 at the rear of the flow connector, for receiving the previously-mentioned air flow line 57. With the bottle connector 70 shown in FIG. 4, the flow connector 73 normally remains installed within the bottle cabinet 12 while the bottle connector 71 (including the attached spigot 72) is unplugged from the flow connector to attach or replace the bottle 22.

As an alternative to the construction shown in FIG. 4, the bottle connector 71 with attached spigot is combined with the flow connector 73 to form a unitary assembly which removably fits within the bottle cabinet. The unitary assembly is removed from the cabinet to attach or replace the beverage bottle. A connector at the rear of the unitary assembly establishes communication with the air flow line 57 when the unitary assembly is installed in the cabinet.

FIG. 4 also shows the bottle adapter 82 which adapts the single-size receptacle 75 to receive other bottle neck sizes. The adapter 82 is a hollow cylindrical shell threaded on the outside 83 to fit within the receptacle 75 in place of the bottle neck intended to fit in that receptacle. The inside 84 of the adapter 82 is threaded to receive a smaller bottle neck. When the adapter 82 is thus screwed into the receptacle 75, that receptacle is adapted for attachment to a particular size of smaller bottle neck.

Figure 5:
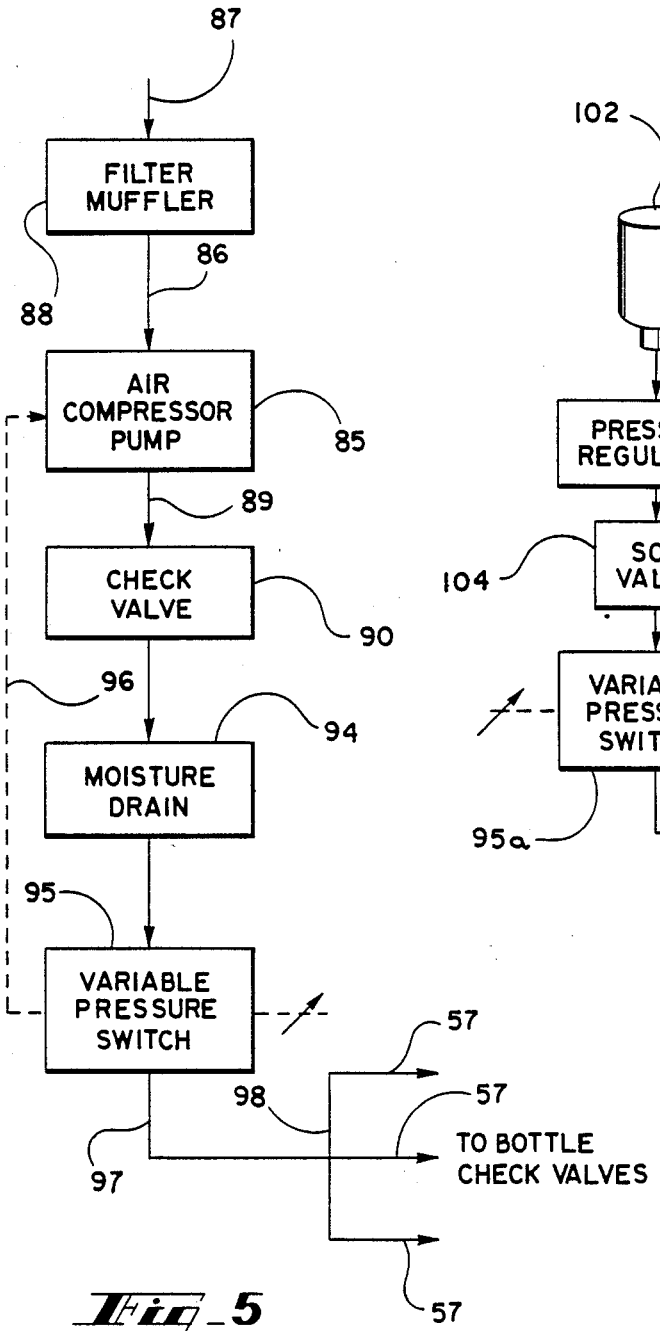
FIG. 5 is a schematic diagram showing the pneumatic flow of the foregoing embodiment.

Pressurized air supplied through the conduits 57 and the bottle connector assemblies 26 or 72 to the individual bottles 22 is the preferred way to maintain head pressure in the bottles according to the present invention, although a pressurized gas such as carbon dioxide or nitrogen also is useful for that purpose. FIG. 5 shows the pneumatic components used with a compressed-air embodiment, some of the components therein being also depicted in FIG. 2. An air compressor 85 is located in the base 11 of the dispensing apparatus. The air inlet to the air compressor 85 connects to an inlet conduit 86 extending upwardly to terminate in the inlet opening 87 located within the refrigerated interior 15 of the bottle cabinet 12. A filter/muffler 88 is connected in series with the inlet conduit 76 to remove particulate matter and muffle the sound of the compressor.

The air compressor 85 in the disclosed embodiment delivers air at the required pressure. The output line 89 from the air compressor 85 goes to a check valve 90 to protect the compressor against possible fluid backflow, and thence to the mositure drain 94 of conventional design. The moisture drain collects condensate in the output from the air compressor 85, although relatively little condensate should be present because the compressor receives cooled and dehumidified air from the interior 15 of the bottle cabinet. The compressed air then flows to the variable pressure switch 95, which senses the amount of air pressure and controls the air compressor in the conventional manner, via the control line 96, to start and stop the compressor as necessary to maintain air pressure within upper and lower limits for a desired pressure range. The upper pressure limit of the switch 95 preferably is selectively variable, so that different pressures are available depending on the nature of the beverages being dispensed.

The output line 97 from the pressure switch 95 connects to a header 98. The individual pressure lines 57 leading to each bottle connector assembly 26 (or 70) branch from the header 98. Because the air compressor 85 receives and compresses cooled air, and then delivers that air to the lines 57 located within the refrigerated interior 15, the compressed air delivered to the bottles 22 is precooled and dehumidified, so that the contents of the bottles are not diluted by condensate in the compressed air supplied to those bottles.

Figure 6:
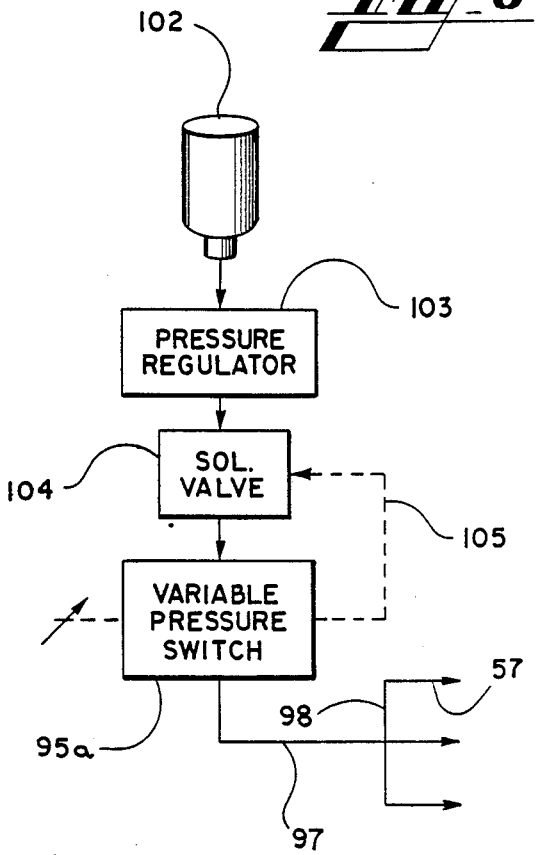
FIG. 6 is a schematic diagram showing an alternative pneumatic flow embodiment.

FIG. 6 shows an alternative embodiment supplying the beverage bottles 22 with pressurized gas from the high-pressure gas cylinder 102, in place of the air compressor 85. It will be understood that the gas cylinder 102 mounts in the base 11 in place of the compressor 19, or alternatively fits behind the bottle cabinet 12, preferably with a quick-disconnect fitting enabling easy replacement of the entire cylinder to replenish the gas supply. Such quick-disconnect fittings are known to the art.

The preferred gas within the cylinder 102 is carbon dioxide when carbonated pre-mixed beverages are used, although nitrogen or other inert and nontoxic gases can be used. For example, nitrogen gas is used when the present apparatus dispenses still wines, because the nitrogen occupies the empty volume in the wine bottle and prevents the wine from oxidizing. The gas pressure inside a fresh cylinder 102 is generally above 200 psi, and that cylinder connects to a pressure regulator 103 which reduces the cylinder gas pressure to the order of about 50 psi.

The output line from the pressure regulator 103 goes to the normally-closed solenoid valve 104, and from the solenoid valve to the pressure sensing switch 95*a*. The switch 95*a* senses the pressure in the volume including the output line 96 leading from the switch, the header line 98, and the branch lines 57, and provides a control signal along the signal line 105 to open the solenoid valve 104 when the sensed pressure drops below a certain pressure; the solenoid valve likewise closes when the sensed pressure exceeds a predetermined amount. For example, the pressure switch 95*a* in an actual embodiment controls the solenoid valve 104 to provide a maximum pressure of about 40 psi in the volume including the lines 96, 98, and 57 (and in the bottles 22 receiving pressurized gas from those lines).

The operation of the present dispensing apparatus is now discussed, referring first to the mechanical embodiment shown in FIG. 3. A bottle connector 28 is first unplugged from the corresponding flow connector 29 and then screwed onto the open neck of a conventional bottle 22 containing a desired pre-mixed beverage, for example, a two-liter bottle of carbonated cola beverage. The bottle connector 28 is tightly screwed onto the upright bottle 22 and the tube 46, if used, extends downwardly nearly to the bottom of the bottle. The bottle 22 with the bottle connector 28 attached now is inverted and placed in the open interior 15 of the bottle cabinet. The check valve 48 prevents any beverage in the line 46 from flowing out the flow connector. Likewise, the normally-closed flap valve 49 in the bottle connector 28 prevents liquid from flowing out the fluid opening 39 at this time.

The bottle connector 28 next is plugged into the flow connector 29 by inserting the plugs 40, 41 into the mating openings 52, 53 in the top of the flow connector 29. The tube 60 in the second opening 53 at this time enters the second flow opening 39 in the bottle connector, opening the normally-closed flap valve 49 and thus establishing a beverage flow path from the bottle 22 to the beverage dispensing tap 62. At the same time, an air flow path from the line 57 into the bottle is established through the tube 46, for introducing pressurized gas to the open space 45 above the top level of the beverage in the now-inverted bottle 22. The tube 46, if necessary, extends into the head space 45 between the top of the beverage and the bottom 47 of the bottle, allowing pressurized gas direct access to the head space without foaming or agitating the beverage in the bottle.

The other two beverage connector assemblies 26 in the dispensing apparatus 10 are likewise fitted with bottled beverages. As mentioned previously, the bottles may be different-sized within the maximum capacity of the bottle cabinet, and bottle necks of different sizes can be accommodated with the double-threaded arrangement shown in FIG. 3, or with the adaptor as previously described with respect to FIG. 4. The doors 13*a*, 13*b* to the bottle cabinet are then closed, and the apparatus is connected to a suitable source of electrical power which activates the refrigeration compressor 19 to cool the interior 15 and also activates the air compressor 85. The air compressor operates until a desired air pressure is reached within the bottles 22, whereupon the pressure switch 95 shuts off the air compressor. The apparatus 10 now is ready to dispense beverages from any tap 62.

As beverages are dispensed from any bottle, the open space 45 in that bottle is constantly maintained at a gas pressure selected to maintain the pre-mixed carbonation of the beverage in solution within the bottle 22. The beverage thus is prevented from losing its pre-mixed carbonation, so that each amount of beverage dispensed from the bottles is substantially as palatable as when the bottle was first uncapped. Furthermore, anyone can dispense as little beverage as desired, without wasting an unused portion of beverage in an individual can or bottle. The relatively constant gas pressure within the battles also maintain a substantially uniform flow of beverage from the spigots whether the bottles are full or nearly empty.

The empty condition of any bottle 22 is apparent when only compressed gas flows from the spigot 66 on actuating a particular tap 62. If desired, a beverage level sensor can be incorporated for each bottle and connected to a suitable indicator light visible from the front of the closed bottle cabinet.

The embodiment of FIG. 4 operates in much the same way as the preceding embodiment. The principal difference is that removing the bottle connector 71 carries with it the spigot 72. When a new bottle 22 is inverted after first firmly attaching the bottle connector 71, the closed spigot 72 prevents liquid from flowing out the bottle and through the opening 74 within the bottle receptacle 75. Of course, the check valve 48 in the gas pressure tube 46 prevents liquid outflow at this time. When the bottle connector 71 is attached to the flow connector 73, gas pressure flow is established into the bottle and the beverage can be dispensed as mentioned above.

Figure 7:
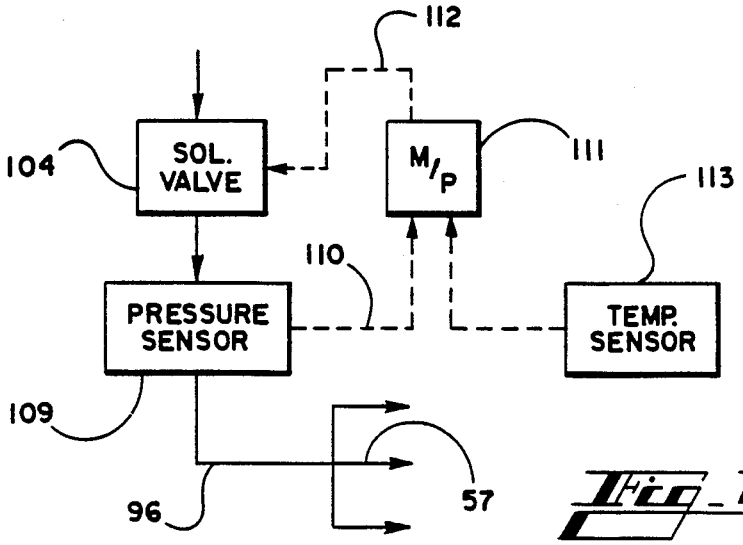
FIG. 7 is a schematic diagram showing an alternative electrical control for the disclosed embodiments.

FIG. 7 shows in schematic form a modification to the variable pressure control described above. This modification, although intended for the pressurized-gas embodiment shown in FIG. 6, can also be used with the compressed-air embodiment of FIG. 5. Referring to FIG. 7, the output gas line from the solenoid valve 104 goes to a pressure sensor 109 which provides an output signal along the line 110 responsive to the amount of pressure in the line 96 including the pressure sensor. This output signal from the pressure sensor is supplied to a microprocessor 111 which is programmed to provide an output signal on the line 112 to operate the solenoid valve 104. The microprocessor 111 also receives a temperature-responsive signal from the temperature sensor 113 located in the refrigerated interior 15 of the bottle cabinet.

The microprocessor 111 is programmed to maintain a pressure within the line 96 (by controlling operation of the solenoid valve 104) that is a predetermined direct function of the temperature in the bottle cabinet. It is known that the amount of pressure necessary to maintain a volume of carbon dioxide in solution in a beverage changes in a certain direct relationship to temperature, as the temperature of the beverage changes. For example, for a certain volume of carbon dioxide gas, a gas pressure of 45 psi is required at 60° F. However, when the temperature is reduced to 40° F., the same carbonating effect is obtained by a gas pressure of about 27 psi. The control apparatus shown in FIG. 7 thus reduces the pressure maintained in the beverage bottles 22 in predetermined and programmed relation to the sensed temperature as the temperature of the beverage drops, and this arrangement thereby reduces the amount of carbon dioxide gas withdrawn from the cylinder 102 to maintain the pressure. Consequently, the apparatus shown in FIG. 7 provides more economical operation and, other factors being unchanged, extends the operational lifetime of a particular volume of gas supplied in each cylinder 102. The nature and programming of the microprocessor 111 is within the skill of the art.

Figure 8:
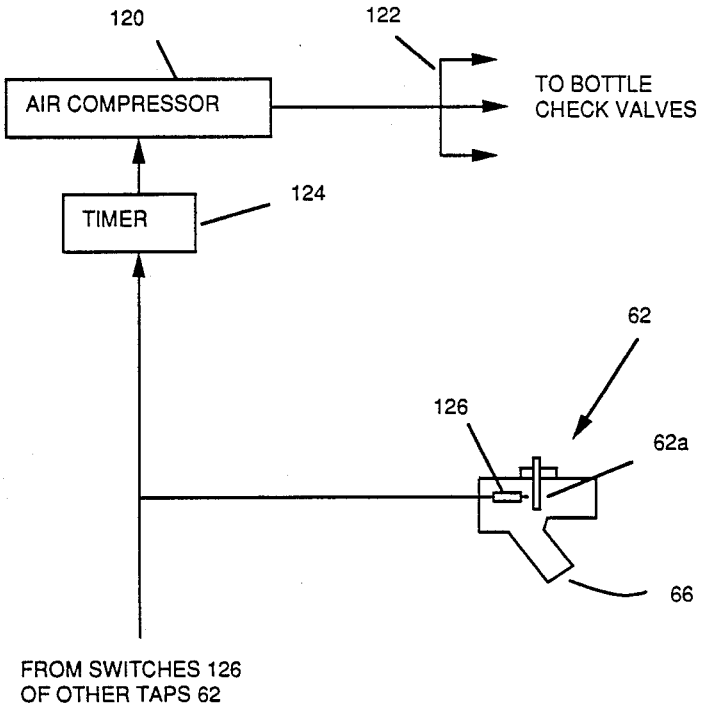
FIG. 8 is a schematic diagram showing another embodiment of the present invention, wherein pressurized air is automatically added to the bottles each time the beverage is dispensed.

FIG. 8 schematically shows an alternative apparatus which automatically refills the head space 45 with pressurized air each time the head space in one of the bottles 22 is increased by dispensing a quantity of beverage from the bottle. The apparatus includes an air compressor 120 operative to supply pressurized air through the conduits 122 to the bottle check valves and bottle connector assemblies as previously described herein. The operation of the air compressor 120 is controlled by the electrical timer circuit 124, which supplies electrical power to the air compressor for a predetermined time in response to a control signal from the switch 126 located immediately behind the actuator 62*a* of the tap assembly 62. It will be understood that each tap assembly 62 of a multiple-bottle beverage dispensing apparatus is equipped with its own switch 126, and that all such switches are connected in parallel to the input of the timer 124. The timer 124 thus is operated in response to actuation of any switch 126 associated with a corresponding tap assembly 62, to operate the air compressor 120 for a predetermined period of time controlled by the timer.

A quantity of beverage is dispensed from one of the taps 62 by pressing rearwardly the actuator 62*a* to open a flow path from the selected bottle to the spigot 66. That rearward movement of the actuator 62*a* engages the switch 126 operatively juxtaposed with the actuator, thereby controlling the timer 124 to supply operating power to the air compressor 120 for a predetermined time. The air compressor during that time supplies pressurized air through the conduits 122 to the head space within each bottle, including the increased head space in the bottle from which the beverage presently is dispensed. The increased head space in that particular bottle thus is automatically refilled with pressurized air, preferably to a pressure sufficient to delay if not prevent dissolution of carbonation from the remaining beverage in the containers.

The operating time of the air compressor 120 depends on the rate at which a particular air compressor can deliver pressurized air to the bottles; the lower the rate of air delivery, the longer the air compressor must operate to supply air sufficient to maintain the desired pressure within the bottles. To prevent overpressurizing the bottles with the apparatus shown in FIG. 8, the air compressor 120 preferably is designed or selected so as to lack the capacity of delivering air at a pressure exceeding a selected maximum allowable pressure within the bottles. Alternatively, the air compressor 120 can be equipped with a pressure-responsive switch which monitors the air pressure supplied to the conduits 122 and stops the compressor in response to a certain maximum air pressure.

The apparatus shown in FIG. 8 thus automatically refills the head space within the bottle with pressurized air each time the head space is increased by dispensing a beverage from the bottle. This automatic replenishment of pressurized air occurs each time a beverage is dispensed, so that the carbonation of the beverage is maintained in solution without need of measuring or monitoring that air pressure. Because the conduits 122 extend in parallel to all bottles and because the air compressor 120 does not deliver air at a pressure exceeding a predetermined maximum pressure, operation of the air compressor 120 in response to dispensing from a particular bottle cannot overpressurize the other bottles although such operation may augment or top-off the air pressure in those other bottles. The apparatus shown in FIG. 8 thus provides a simplified yet effective way of maintaining carbonation in pre-mixed beverages while dispensing those beverages from bottles or other containers in which the beverages normally are available.

It should be understood that the foregoing relates only to preferred embodiments of the present invention, and that many changes and modifications can be made therein without departing from the spirit and scope of the invention as defined in the following claims.

I claim:

1. Apparatus for dispensing pre-mixed carbonated beverage in a bottle normally capped to maintain the carbonation, comprising:

means for receiving a bottle of carbonated beverage;

dispensing means communicating with the interior of the bottle and selectively operable to dispense a quantity of liquid from the bottle, thereby increasing the head space within the bottle;

means operative in response to each dispensing operation for supplying pressurized air to the interior of the bottle; and timer means responsive to operation of the dispensing means to operate the air supplying means for a fixed time so that the increased head space within the bottle is supplied with pressurized air, thereby maintaining in suspension the carbonation of the liquid remaining within the bottle.

2. Apparatus as in claim 1, wherein:

the dispensing means is one of plural dispensing means associated with a plurality of bottles containing pre-mixed carbonated beverage;

each dispensing means comprises an actuator selectively operative to dispense liquid from a specific bottle;

the means for supplying pressurized air includes an air compressor operative to supply air in parallel to the plurality of bottles; and the timer means is operatively associated with each of the actuators to operate the air compressor for said fixed time in response to each operation of an actuator.

3. Apparatus as in claim 2, further comprising:

electrical switch means operative in response to each of the actuators and connected to the timer means so as to initiate the timed operation of the air compressor for said fixed time whenever liquid is dispensed from any of the bottles.

4. Apparatus as in claim 1, wherein:

the means for receiving a bottle comprises a bottle connector means selectively attachable to the bottle and providing first and second fluid passages into the bottle;

the dispensing means being selectively connected to one of the fluid passages to receive the beverage within the bottle; and the means for supplying pressurized air is selectively connected to the other fluid passage to supply pressurized air into the bottle.

5. Apparatus as in claim 4, wherein:

the means for supplying pressurized air comprises an air compressor; and further comprising control switch means responsive to operation of the dispensing means to actuate the timer means thereby operating the air compressor for said fixed time.

6. Apparatus as in claim 1, wherein:

the dispensing means comprises an actuator selectively operable to dispense liquid; and further comprising the means for supplying pressurized air includes an air compressor; and the timer means is responsive to operation of the actuator to operate the air compressor for said fixed time.

7. Apparatus for storing and dispensing pre-mixed carbonated beverages in bottles normally capped to preserve the carbonation, comprising:

enclosure means including a region for receiving at least one bottle of carbonated beverage;

bottle connector means selectively attachable to the bottle in place of the bottle cap, said bottle connector means providing first and second fluid passages into the bottle;

flow connector means associated with said enclosure means to detachably receive said bottle connector means in fluid flow connection with a first one of said fluid passages;

a source of pressurized gas associated with said enclosure means and operative to supply the gas to said flow connector means for flow communication to said first flow passage in said attached bottle connector means and thence to the bottle, at a pressure to maintain the carbonation of the pre-mixed beverage in the bottle;

said source of pressurized fluid comprising a supply of gas at a relatively high pressure greater than the gas pressure supplied to the bottle;

means receiving said gas at high pressure and reducing the pressure to a relatively reduced pressure greater than the gas pressure supplied to the bottle;

a fluid manifold having an inlet and an outlet;

valve means interconnecting said fluid manifold inlet with the gas at said relatively reduced pressure;

pressure responsive means responsive to gas pressure in aid manifold and selectively operating said valve means to maintain said reduced pressure in the manifold within a certain range of pressures;

means connecting the outlet of said manifold to said flow connector means, for flow communication to said flow passage; and dispensing valve means operatively connected in flow relation with the second said fluid passage and selectively openable to dispense a quantity of liquid from the bottle, whereby the volume above the beverage in the bottle remains under gas pressure sufficient to maintain the carbonation in solution in the remaining beverage and to maintain substantially uniform flow delivery from the dispensing valve means.

8. Apparatus as in claim 7, wherein:

said enclosure means includes a refrigerated region for receiving the bottle attached to said connector means;

said supply of gas being outside said refrigerated region;

said pressure responsive means comprises pressure sensing means producing a pressure signal responsive to gas pressure in said manifold;

temperature sensing means producing a temperature signal responsive to the temperature within the refrigerated region; and microprocessor means responsive to said temperature signal and said pressure signal, and controlling said valve means to maintain said gas pressure in the manifold as a predetermined direct function of the beverage temperature, so that the amount of gas required to pressurize the beverage in the bottle is reduced as the temperature is lowered, thereby conserving use of gas by the apparatus.

9. Apparatus as in claim 7, wherein:

said enclosure means comprises a refrigerated compartment for receiving said bottle connector means and the bottle attached thereto, and an unrefrigerated region;

said supply of gas being located in said unrefrigerated region; and said fluid manifold being located in said refrigerated compartment so that the gas in the manifold becomes precooled before entering the bottle.

10. Apparatus for storing and dispensing pre-mixed carbonated beverages in bottles normally capped to preserve the carbonation, comprising:

enclosure means including a region for receiving at least one bottle of carbonated beverage;

bottle connector means selectively attachable to the bottle in place of the bottle cap, said bottle connector means providing first and second fluid passages into the bottle;

flow connector means associated with said enclosure means to detachably receive said bottle connector means in fluid flow connection with a first one of said fluid passages;

a source of pressurized gas associated with said enclosure means and operative to supply the gas to said flow connector means for flow communication to said first flow passage in said attached bottle connector means and thence to the bottle, at a pressure to maintain the carbonation of the pre-mixed beverage in the bottle;

dispensing valve means operatively connected in flow relation with the second said fluid passage and selectively openable to dispense a quantity of liquid from the bottle, whereby the volume above the beverage in the bottle remains under gas pressure sufficient to maintain the carbonation in solution in the remaining beverage and to maintain substantially uniform flow delivery from the dispensing valve means;

said bottle connector means being received at a lower portion of said region within the enclosure means, so that the bottle attached to the bottle connector means is inverted in said region;

a one-way valve in line with said one flow passage of the bottle connector means to permit pressurized gas flow through said on flow passage and into the inverted bottle, but to prevent gas flow from the bottle through said one flow passage;

said dispensing valve means being connected to said flow connector means so that a beverage flow path through said second fluid passage to the dispensing valve means is established when said bottle connector means is received by the flow connector means;

a valve associated with said bottle connector means in line with said beverage flow path and normally closed so as to prevent the beverage from flowing out said bottle connector means when the bottle is inverted before said bottle connector means is received by said flow connector means; and means associated with said flow connector means to open said valve in the beverage flow path when said bottle connector means engages said flow connector, so that the beverage in the inverted bottle can thereafter flow to the dispensing valve means.

* * * * *